US007382890B2

(12) United States Patent
Saiki et al.

(10) Patent No.: US 7,382,890 B2
(45) Date of Patent: Jun. 3, 2008

(54) SOUND REPRODUCTION DEVICE AND PORTABLE TERMINAL APPARATUS

(75) Inventors: Shuji Saiki, Uda-gun (JP); Sawako Usuki, Kobe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 486 days.

(21) Appl. No.: 10/901,112

(22) Filed: Jul. 29, 2004

(65) Prior Publication Data

US 2005/0025330 A1 Feb. 3, 2005

(30) Foreign Application Priority Data

Jul. 31, 2003 (JP) ..... 2003-284343

(51) Int. Cl.
*H04R 25/00* (2006.01)

(52) U.S. Cl. ..... 381/152; 381/350

(58) Field of Classification Search ..... 381/152, 381/306, 311, 333, 350, 365, 388
See application file for complete search history.

(56) References Cited

U.S. PATENT DOCUMENTS 6,332,029 B1 * 12/2001 Azima et al. ..... 381/152
7,151,837 B2 * 12/2006 Bank et al. ..... 381/152
7,174,025 B2 * 2/2007 Azima et al. ..... 381/152

FOREIGN PATENT DOCUMENTS

| | | |
|---|---|---|
| JP | 1-90086 | 6/1989 |
| JP | 3-34391 | 4/1991 |

* cited by examiner

*Primary Examiner*—Suhan Ni
(74) *Attorney, Agent, or Firm*—Wenderoth, Lind & Ponack, L.L.P.

(57) ABSTRACT

A sound reproduction device includes an LCD 20, which is an exemplary front panel, a case 22, and an electromechanical acoustic transducer 23. The LCD 20 is operable to perform a predetermined operation in response to an electrical signal applied thereto. A space 24 for sound emission is formed between the case 22 and the LCD 20. The electromechanical acoustic transducer 23 is connected to the case 22, and emits sound to the space 24. If the electromechanical acoustic transducer 23 emits the sound to the space 24, energy of the emitted sound causes the LCD 20 to vibrate and thereby to externally output the sound.

23 Claims, 10 Drawing Sheets

SOUND REPRODUCTION DEVICE AND PORTABLE TERMINAL APPARATUS

BACKGROUND OF THE INVENTION

1. Field of the Invention

The present invention relates to a sound reproduction device and a portable terminal apparatus including the acoustic reproduction device. More particularly, the present invention relates to a sound reproduction device having a capability of acoustically driving a panel with sound pressure, and a portable terminal apparatus including the same acoustic reproduction device.

2. Description of the Background Art

Conventionally, it is considered to be important to reduce dimensions or thickness of an electronic apparatus, in particular, a portable apparatus. For example, it is conceivable to integrate two devices in an electronic apparatus, which differ in their functions, into one device, and thereby to reduce the entire size of the apparatus. Described next is a case where a sound reproduction capability is added to an apparatus having a specific capability in order to achieve a size reduction, typically a case where the sound reproduction capability is added to a display device.

Conventionally, there have been techniques devised for integrating a display device and a sound reproduction device together. FIG. 12 is a perspective view showing a conventional display device having a sound reproduction capability. In FIG. 12, a display device 1 includes a display panel 2, an organic electroluminescent (EL) panel 3, a film speaker 4, and electrical signal cords 5 and 6. The display panel 2, the organic EL panel 3, and the film speaker 4 are integrated together by an adhesive or the like. Hereinbelow, an operation of the display device 1 is described.

The display panel 2 has characters or the like printed thereon. The display panel 2 is illuminated from behind by the organic EL panel 3 to which voltage is applied via the electrical signal cord 5, so that the characters or the like printed on the display panel 2 are displayed. The film speaker 4 is made of, for example, a resin film having a piezoelectric effect, and caused to vibrate when an acoustic signal is applied thereto via the electrical signal cord 6, so that the display panel 2 and the organic EL panel 3, which are integrated together with the film speaker 4, are caused to mechanically vibrate, thereby generating sound. The above-described display device 1 is capable of making the user feel as if the sound is being generated by a display screen.

There is another conventional technique which makes the user feel as if the sound is being generated by the display screen. Specifically, in this conventional technique, reproduced sound is outputted from a loudspeaker provided on the front of the display device. FIG. 13 is a cross-sectional view of a conventional display device in which reproduced sound is outputted from a loudspeaker provided on the front thereof. In FIG. 13, a display device 10 includes a transparent diaphragm 11, a plurality of transparent electrodes 12 formed on both sides of the transparent diaphragm 11, a support 13, and a cathode ray tube (CRT) 14. Hereinbelow, an operation of the display device 10 is described.

Each transparent electrode 12 is connected to a cord (not shown) via which an electrical signal is applied thereto. The transparent diaphragm 11 is made of a polymeric piezoelectric sheet material, and caused to vibrate by an electrical signal supplied from the plurality of transparent electrodes 12, thereby generating sound. The transparent diaphragm 11 and the plurality of transparent electrodes 12 are made of transparent materials, and therefore an image on the cathode ray tube can be seen therethrough, whereby it makes the user feel as if the sound is being generated by a cathode ray tube screen.

In the above-described display device 1, three elements, i.e., the display panel 2, the organic EL panel 3, and the film speaker 4, are integrated together, and therefore the film speaker 4 is caused to vibrate together with the display panel 2 and the organic EL panel 3, thereby reproducing sound. However, a diaphragm formed by the three elements integrated together is heavy in weight, resulting in reduction of a pressure level of sound to be reproduced. Moreover, an integral structure of the three elements increases the stiffness of the diaphragm, and therefore the diaphragm has difficulty in vibrating at low frequencies, resulting in reduction of low-frequency sound pressure levels.

In the above-described display device 10, the screen of the cathode ray tube 14 is entirely covered by the transparent diaphragm 11, and a space between the cathode ray tube 14 and the transparent diaphragm 11 is kept small in order to save space. Accordingly, an acoustic compliance of the space is considerably small, making it difficult for the display device 10 to perform satisfactory low-frequency sound reproduction.

As described above, conventionally, in the case where a display device and a sound reproduction device are integrated together, the sound reproduction device has difficulty in performing satisfactory sound reproduction (in particular, satisfactory low-frequency sound reproduction). This is not restricted to the display device, and a similar problem can be caused to a device having a different capability if a sound reproduction capability is additionally added thereto. It is conceivable that if the film speaker is provided to add the sound reproduction capability to the device having a different capability, the capability of the film speaker is reduced due to the mass and stiffness of the device.

SUMMARY OF THE INVENTION

Therefore, an object of the present invention is to provide a sound reproduction device having an improved sound reproduction capability by adding a sound reproduction capability to a device having a capability other than the sound reproduction capability.

The present invention has the following features to attain the object mentioned above. Specifically, the present invention is directed to a sound reproduction device which includes a front panel, a case, and an electromechanical acoustic transducer. The front panel is operable to perform a predetermined operation in response to an electrical signal applied thereto. The case forms a sound emission space with the front panel. The electromechanical acoustic transducer is operable to emit sound to the sound emission space, and is connected to the case. If the electromechanical acoustic transducer emits the sound to the sound emission space, energy of the emitted sound causes the front panel to vibrate and thereby to externally output sound.

The front panel may be an image display panel which displays an image in response to the electrical signal. Typically, the image display panel maybe a liquid crystal display. In this case, the case may support an outer peripheral portion of the liquid crystal display via an elastic body. Moreover, the front panel may be a film-like display panel such as an organic electroluminescent panel.

Further, the front panel maybe a sound generation panel operable to reproduce sound in response to the electrical signal. For example, the sound generation panel is composed of a piezoelectric element. Alternatively, the sound generation panel may be made of a transparent material.

In the case where the front panel is the sound generation panel, the sound reproduction device may further include a high-frequency component extraction unit operable to extract a high-frequency component higher than a first predetermined frequency from an acoustic signal to be reproduced. In this case, the sound generation panel receives a signal of the high-frequency component extracted by the high-frequency component extraction unit, and the electromechanical acoustic transducer receives the acoustic signal.

Alternatively, in the case where the front panel is the sound generation panel, the sound reproduction device may further include: a high-frequency component extraction unit operable to extract a high-frequency component higher than a first predetermined frequency from an acoustic signal to be reproduced; and a low-frequency component extraction unit operable to extract a low-frequency component lower than a second predetermined frequency, which is lower than or equal to the first predetermined frequency, from the acoustic signal. In this case, the sound generation panel receives a signal of the high-frequency component extracted by the high-frequency component extraction unit, and the electromechanical acoustic transducer receives a signal of the low-frequency component extracted by the low-frequency component extraction unit.

Alternatively still, in the case where the front panel is the sound generation panel, the sound reproduction device may further include a level adjustment unit operable to perform a level adjustment on at least either an acoustic signal to be inputted to the sound generation panel or an acoustic signal to be inputted to the electromechanical acoustic transducer, such that a reproduction sound pressure level of the sound generation panel in the case where a predetermined acoustic signal is inputted to the sound generation panel is substantially equal to a reproduction sound pressure level of the sound generation panel in the case where the predetermined acoustic signal is inputted to the electromechanical acoustic transducer.

Alternatively still, in the case where the front panel is the sound generation panel, the sound reproduction device may further include a phase adjustment unit operable to perform a phase adjustment on at least either an acoustic signal to be inputted to the sound generation panel or an acoustic signal to be inputted to the electromechanical acoustic transducer, such that sound reproduced by the sound generation panel in the case where a predetermined acoustic signal is inputted to the sound generation panel and sound reproduced by the sound generation panel in the case where the predetermined acoustic signal is inputted to the electromechanical acoustic transducer are not in antiphase with each other in a predetermined frequency band.

Note that typically, the case has a sound hole, and the electromechanical acoustic transducer emits the sound from the sound hole to the sound emission space. The sound reproduction device may further include an acoustic tube coupling the case to the electromechanical acoustic transducer. In this case, the case has a sound hole at a connection to the acoustic tube, and the electromechanical acoustic transducer emits the sound from the sound hole through the acoustic tube to the sound emission space.

Note that typically, the electromechanical acoustic transducer is driven by any one of an electrodynamic scheme, an electromagnetic scheme, an electrostatic scheme, and a piezoelectric scheme.

Note that the front panel may include: an image display panel which displays an image in response to the electrical signal; and a sound generation panel which reproduces the sound in response to the electrical signal and is integrally formed with the image display panel. For example, the image display panel is an organic electroluminescent panel, and the sound generation panel is composed of a piezoelectric film. The sound generation panel may be provided across an entire surface of the image display panel or a part of the entire surface.

Note that the sound generation panel is driven by any one of an electrodynamic scheme, an electromagnetic scheme, an electrostatic scheme, and a piezoelectric scheme.

Alternatively, the present invention may be provided in the form of an electronic apparatus including the sound reproduction device as described above. In this case, an image signal to be reproduced is inputted to a front panel, and an acoustic signal to be reproduced is inputted to an electromechanical acoustic transducer. The electronic apparatus may further include a signal amplification unit operable to amplify the acoustic signal to be reproduced. The signal amplification unit is capable of changing an amplification factor in accordance with a user's instruction.

Alternatively still, the present invention may be provided in the form of a portable terminal apparatus including the sound reproduction device as described above. In this case, portable terminal apparatus includes: an antenna operable to receive a received signal containing at least one of acoustic and image signals; and a received signal processing unit operable to perform a predetermined signal process on the received signal. If the received signal contains the image signal, the received signal processing unit inputs the image signal to a front panel, and if the received signal contains the acoustic signal, the received signal processing unit inputs the acoustic signal to an electromechanical acoustic transducer.

Note that the acoustic signal may be an incoming speech signal indicating an incoming speech sound. In this case, the electromechanical acoustic transducer receives the incoming speech signal as the acoustic signal.

The portable terminal apparatus may further include an amplification unit operable to amplify the acoustic signal to be inputted to the electromechanical acoustic transducer. Note that an amplification factor of the signal amplification unit is variable.

In the present invention, the front panel for performing a predetermined operation is caused to vibrate by itself and thereby to emit sound, and therefore it is possible to add a sound reproduction capability to a device having a capability other than the sound reproduction capability, thereby achieving a reduction of a device size. Further, high-frequency sound reproduction can be realized by acoustically driving the front panel, thereby improving the sound reproduction capability.

Note that the sound reproduction capability can be added to an image display device by using an image display panel as the front panel. In this case, it is possible to make the user feel as if sound is being emitted from an image. Note that in the case where the image display panel is an LCD, if a case supports an outer peripheral portion of the LCD via an elastic body, it is possible to readily cause the LCD to vibrate.

Further, in the case where the front panel is a sound generation panel such as a piezoelectric element, it is possible to perform wider frequency sound reproduction Furthermore, in the case where the sound reproduction device includes a high-frequency component extraction unit, the sound generated by vibration of the sound generation panel itself can be restricted to high-frequency sound.

Accordingly, it is possible to reduce interference between the vibration of the sound generation panel itself and vibration caused by the electromechanical acoustic transducer, thereby improving sound quality. Moreover, in the case where the sound reproduction device includes the high-frequency component extraction unit, it is ensured that the sound generated by the vibration caused by the electromechanical acoustic transducer is restricted to low-frequency sound. Accordingly, it is possible to further reduce the interference between the vibration of the sound generation panel itself and the vibration caused by the electromechanical acoustic transducer, thereby further improving sound quality.

Further still, in the case where the sound reproduction device further includes a level adjustment unit, it is possible to equalize a sound pressure level of the sound generated by the vibration of the sound generation panel itself with a sound pressure level of the sound generated by the vibration caused by the electromechanical acoustic transducer. This allows sounds within a wide frequency range to be outputted with a constant level, thereby improving sound quality.

Further still, in the case where the sound reproduction device further includes a phase adjustment unit, it is possible to prevent the sound pressure level from being reduced due to the interference between the vibration of the sound panel itself and the vibration caused by the electromechanical acoustic transducer.

Further still, in the case where the case has a sound hole, it is possible to readily lead the sound emitted by the electromechanical acoustic transducer to the space. Moreover, in the case where the sound reproduction device further includes an acoustic tube, it is possible to place the electromechanical acoustic transducer in an arbitrary location. Accordingly, the freedom of design is increased, whereby it is possible to realize a more compact sound reproduction device and an electronic apparatus including the more compact sound reproduction device.

The sound reproduction device of the present invention is applicable to an electronic apparatus. Moreover, in the case where the electronic apparatus has a signal amplification unit, the front panel can be used as a loudspeaker.

Further, the sound reproduction device is applicable to a portable terminal apparatus. For example, it is possible to use the sound reproduction device to reproduce an incoming speech signal. Moreover, in the case where an amplification unit is used, the front panel can be selectively operated in either a normal mode (where the user holds his/her ear close to the front panel) or in another mode where the front panel is used as a loudspeaker.

These and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1A:
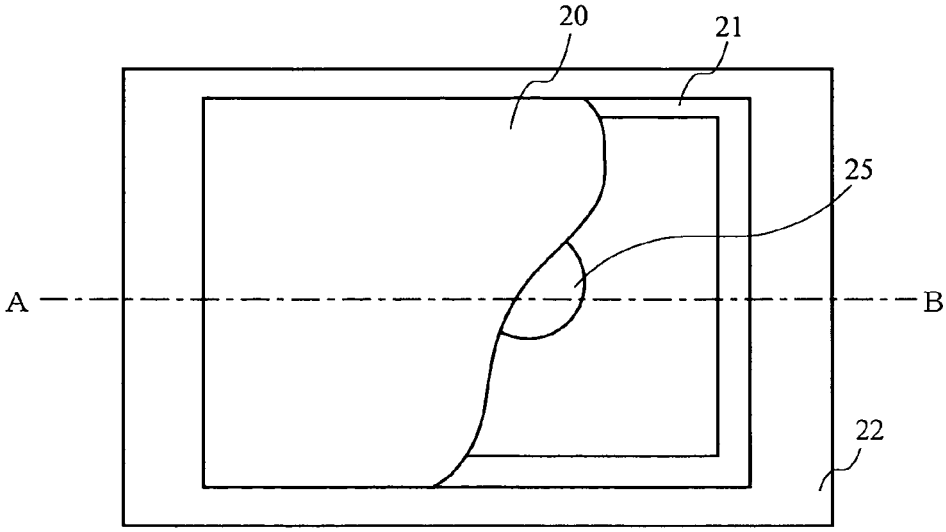
FIGS. 1A and 1B each illustrate a sound reproduction device according to a first embodiment.
Figure 1B:
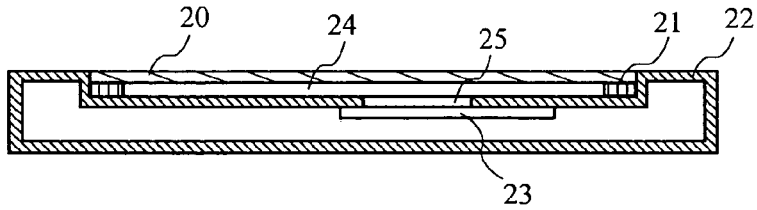

A sound reproduction device according to a first embodiment of the present invention is described below. FIGS. 1A and 1B each illustrate the sound reproduction device according to the first embodiment. Specifically, FIG. 1A is a plan view of the sound reproduction device shown partially broken away, and FIG. 1B is a cross-sectional view of the sound reproduction device taken along line A-B of FIG. 1A. In FIG. 1A, the sound reproduction device includes a liquid crystal display (LCD) 20, a suspension member 21, a case 22, and an electromechanical acoustic transducer 23. In the first embodiment, as shown in FIG. 1B, the LCD 20, which is an exemplary image display panel for displaying an image, is used as a front panel from which sound is emitted. Note that in FIG. 1A, the LCD 20 is shown partially broken away. The sound reproduction device includes an electronic circuit for controlling an image signal supplied to the LCD 20 and an electronic circuit for controlling an acoustic signal supplied to the electromechanical acoustic transducer 23. For the sake of simplification of explanation, descriptions of the electronic circuits are omitted herein. Similarly, in embodiments other than the first embodiment, descriptions of electronic circuits, etc., which are not directly related to the present invention, are omitted herein.

As shown in FIG. 1B, the case 22 has a portion having a concave cross section. This portion is equal in size to the LCD 20, and the LCD 20 is attached to the case 22 so as to be embedded in this portion. The suspension member 21 is an elastic body used for the case 22 to support the LCD 20. The suspension member 21 is provided between the case 22 and the LCD 20 so as to support an outer peripheral portion of the LCD 20. Specifically, the LCD 20 is attached to the case 22 via the suspension member 21 so as to form a space 24 between the case 22 and the LCD 20. The case 22 is hollowed inside, and a sound hole 25 is provided in the portion having the concave cross section. The electromechanical acoustic transducer 23 is provided within the case 22 so as to be coupled to the sound hole 25. This allows the sound hole 25 to play a role of acoustic coupling means for transferring sound emitted by the electromechanical acoustic transducer 23 to the space 24. It is preferred that the space 24 is configured so as to be kept airtight in order to prevent leakage of the sound emitted by the electromechanical acoustic transducer 23.

Figure 2:
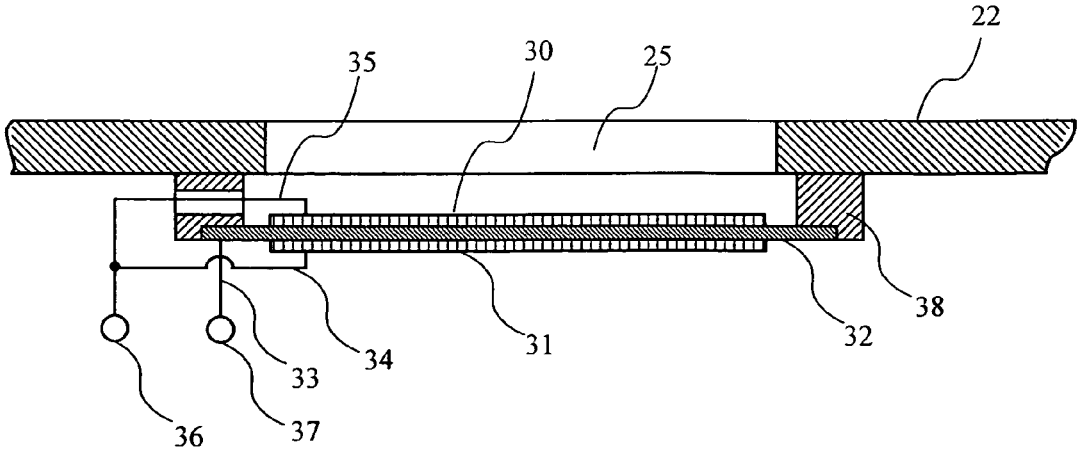
FIG. 2 is a cross-sectional view showing a structure of an electromechanical acoustic transducer 23 shown in FIG. 1A.

FIG. 2 is a cross-sectional view showing a structure of the electromechanical acoustic transducer 23 shown in FIG. 1A. Note that the electromechanical acoustic transducer 23 described in the first embodiment is a piezoelectric loudspeaker. However, the transducer scheme of the electromechanical acoustic transducer 23 may be of, for example, an electrodynamic type, an electromagnetic type, or an electrostatic type. An electromechanical acoustic transducer of any type can achieve a similar effect so long as it has the capability of emitting sound from a diaphragm. Note that in second and subsequent embodiments, the transducer scheme of the electromechanical acoustic transducer can be of any type.

In FIG. 2, the electromechanical transducer 23 includes piezoelectric elements 30 and 31, an intermediate electrode 32, leads 33, 34, and 35, input terminals 36 and 37, and a frame 38. The frame 38 is connected to the case 22 so as to support an outer peripheral portion of the intermediate electrode 32. Affixed on one surface of the intermediate electrode 32 is the piezoelectric element 30, and affixed on the other surface is the piezoelectric element 31. The piezoelectric elements 30 and 31 are made of, for example, a conductive material such as phosphor bronze. The lead 33 is provided for inputting electricity to the intermediate electrode 32, and connecting the input terminal 37 and the intermediate electrode 32. The lead 34 is provided for inputting electricity to the piezoelectric element 31, and connecting the input terminal 36 and the intermediate electrode 31. The lead 35 is provided for inputting electricity to the piezoelectric element 30, and connecting the input terminal 36 and the intermediate electrode 30.

Described next is an operation of the sound reproduction device structured as shown in FIGS. 1A, 1B, and 2. If an electrical signal is applied to the input terminals 36 and 37 of the electromechanical acoustic transducer 23, the piezoelectric elements 30 and 31 generate bending vibration, thereby emitting sound from the intermediate electrode 32 and the piezoelectric elements 30 and 31. The sound is transferred through the sound hole 25 to the space 24. As a result, the sound pressure in the space 24 causes the LCD 20 to vibrate and thereby to emit sound. In this manner, the LCD 20 is acoustically driven to perform sound reproduction.

In comparison to a diaphragm of an ordinary loudspeaker, the LCD 20 is considerably heavy in weight. However, by designing the electromechanical acoustic transducer 23 so as to have a diaphragm area Sd which is less than an area Sl of the LCD 20, it is made possible to reduce an equivalent weight of LCD 20 to less than the weight of the diaphragm of the electromechanical acoustic transducer 23. This is because the equivalent weight is proportional to a reciprocal of the square of an area ratio (Sd/Sl). Accordingly, by designing the electromechanical acoustic transducer 23 to have a relatively small diaphragm area Sd and designing the LCD 20 so as to have a relatively large area Sl, it is made possible to prevent a reduction of a sound pressure level. Therefore, even if the LCD 20, which is heavy in weight, is used as a diaphragm for sound reproduction, it is possible to perform satisfactory low-frequency sound reproduction.

Since the LCD 20, which is a front panel, has the capability of reproducing an image based on an image signal, the LCD 20 acts as an image reproduction device, while having the capability of a sound reproduction device. Thus, in the first embodiment, it is possible to realize a sound reproduction device capable of simultaneously reproducing an image and sound using a front panel. Such a sound reproduction device can typically be applied to an electronic apparatus, such as a mobile telephone, a game apparatus, a personal computer, and a television.

Figure 13:
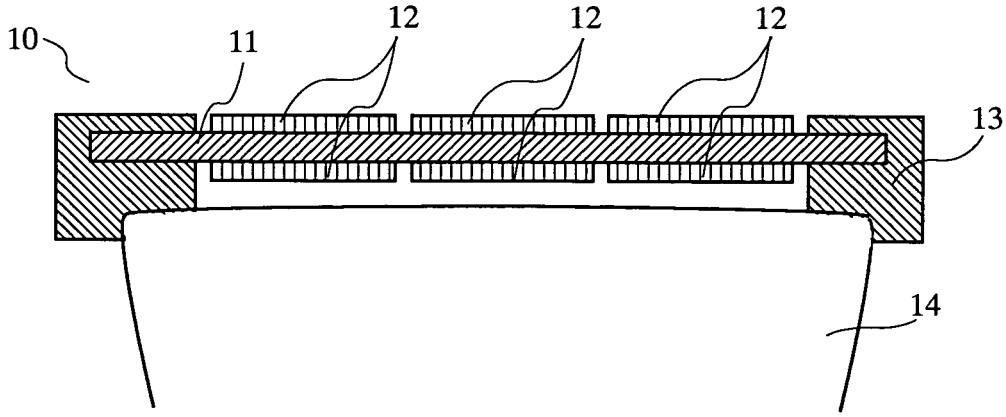
FIG. 13 PRIOR ART
FIG. 13 is a cross-sectional view of a conventional display device in which reproduced sound is outputted from a loudspeaker provided on the front thereof.

Note that in the above-described conventional case where a transparent sound reproduction device is provided on the front of a display device for reproducing an image (see FIG. 13), there is a problem that the image reproduced might be unclear. Specifically, in the display device 10 shown in FIG. 13, in order to present an image displayed on the cathode ray tube 14 to the viewer as clearly as possible, it is required to use a material having as high a transmission factor as possible to form the transparent diaphragm 11 and the transparent electrode 12 which are provided on the front of the display device. However, transmission factors of the transparent diaphragm 11 and the transparent electrode 12 are limited, and therefore clearness of an image displayed on the cathode ray tube 14 is limited. On the other hand, in the first embodiment, the display panel for reproducing an image reproduces sound by itself, and therefore it is not necessary to provide a transparent element for emitting sound on the front of the display panel. Accordingly, in comparison to the conventional display device with a transparent sound reproduction device provided on the front thereof, the image can be presented more clearly. Further, in the first embodiment, in comparison to a conventional display device with a transparent diaphragm provided on the front thereof, further reduction in thickness can be achieved.

Second Embodiment

Figure 3A:
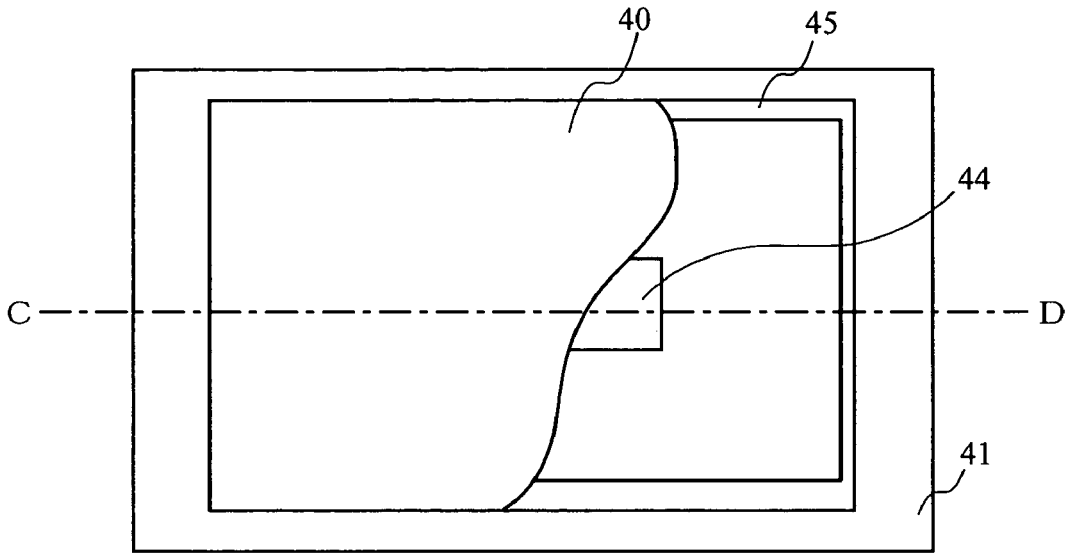
FIGS. 3A and 3B each illustrate a sound reproduction device according to a second embodiment.
Figure 3B:
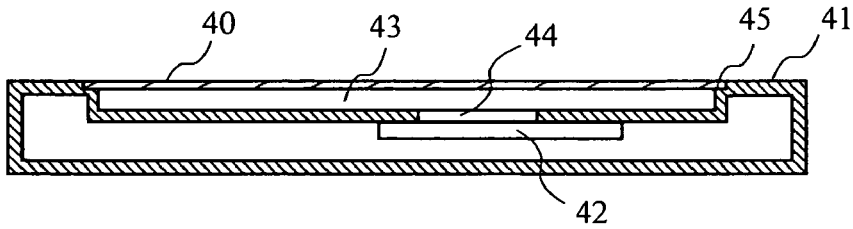

A sound reproduction device according to a second embodiment is described below. FIGS. 3A and 3B each illustrate the sound reproduction device according to the second embodiment. Specifically, FIG. 3A is a plan view of the sound reproduction device shown partially broken away, and FIG. 3B is a cross-sectional view of the sound reproduction device taken along line C-D of FIG. 3A. In FIGS. 3A and 3B, the sound reproduction device includes a film-like organic electroluminescent (EL) panel 40, a case 41, and an electromechanical acoustic transducer 42. In the second embodiment, as shown in FIG. 3B, the organic EL panel 40 is used as a front panel for emitting sound. Note that in FIG. 3A, the organic EL panel 40 is shown partially broken away.

The sound reproduction device shown in FIG. 3A differs from the sound reproduction device according to the first embodiment in that instead of using the LCD 20, the film-like organic EL panel 40 is used as a front panel. In FIG. 3A and 3B, the organic EL panel 40 is directly fixed at its outer peripheral portion to a fixation surface 45 of the case 41 (without the intervention of any suspension member). The case 41 has stiffness greater than that of the organic EL panel 40. As in the first embodiment, there is a space 43 formed between the case 41 and the organic EL panel 40. Note that the case 41 and the electromechanical acoustic transducer 42 are configured similar to the case 22 and the electromechanical acoustic transducer 23, respectively, of FIG. 1A.

Described next is an operation of the sound reproduction device structured as shown in FIGS. 3A and 3B. Sound generated by the electromechanical acoustic transducer 42 is transferred through a sound hole 44 to the space 43. Among the case 41 and the organic EL panel 40 which form the space 43, the organic EL panel 40 has lower stiffness, and therefore it is the organic EL panel 40 that is caused to vibrate by energy (sound pressure) of the sound emitted from the electromechanical acoustic transducer 42 to the space 43. That is, the electromechanical acoustic transducer 42 acoustically drives the organic EL panel 40 to vibrate and thereby to generate sound.

Note that in the second embodiment, instead of using an LCD which is similar in structure to a rigid body and considerably heavy, the organic EL panel 40 having stiffness lower than that of the case 41 is used as a front panel. Therefore, no suspension member is required for supporting the outer peripheral portion of the organic EL panel 40, and the organic EL panel 40 can be directly connected at the outer peripheral portion to the case 41. Accordingly, in comparison to a case of using the LCD, the structure of the sound reproduction device can be simplified. Further, in comparison to the case of using the LCD, the sound reproduction device can be reduced in thickness. Furthermore, since the organic EL panel 40 is lighter in weight than the LCD, in comparison to the case of using the LCD, sound reproduction can be performed more efficiently, and high-frequency sound reproduction can be readily performed.

The structure as shown in FIGS. 3A and 3B allows the organic EL panel 40, which is a front panel, to have the capability of a sound reproduction device, while acting as an image reproduction device. Thus, in the second embodiment, it is possible to realize a sound reproduction device capable of simultaneously reproducing an image and sound using a front panel. Similar to the sound reproduction device according to the first embodiment, the sound reproduction device according to the second embodiment can typically be applied to an electronic apparatus, such as a mobile telephone, a game apparatus, a personal computer, and a television. Further, as in the first embodiment, in comparison to a conventional case where a transparent sound reproduction device is provided on the front of a display device for reproducing an image (see FIG. 13), the image can be presented more clearly. Further, as in the first embodiment, in comparison to a conventional display device with a transparent diaphragm provided on the front thereof, further reduction in thickness can be achieved.

Note that in the second embodiment, although one electromechanical acoustic transducer 42 is provided behind the organic EL panel 40, two electromechanical acoustic transducers may be separately provided so as to be away from each other. In this case, one electromechanical acoustic transducer is operable to receive a left-channel signal of a stereo signal, and the other electromechanical acoustic transducer is operable to receive a right-channel signal of the stereo signal. Thus, it is possible for the film-like organic EL panel 40 to reproduce stereo sound simultaneously as reproducing sound.

Third Embodiment

Figure 4A:
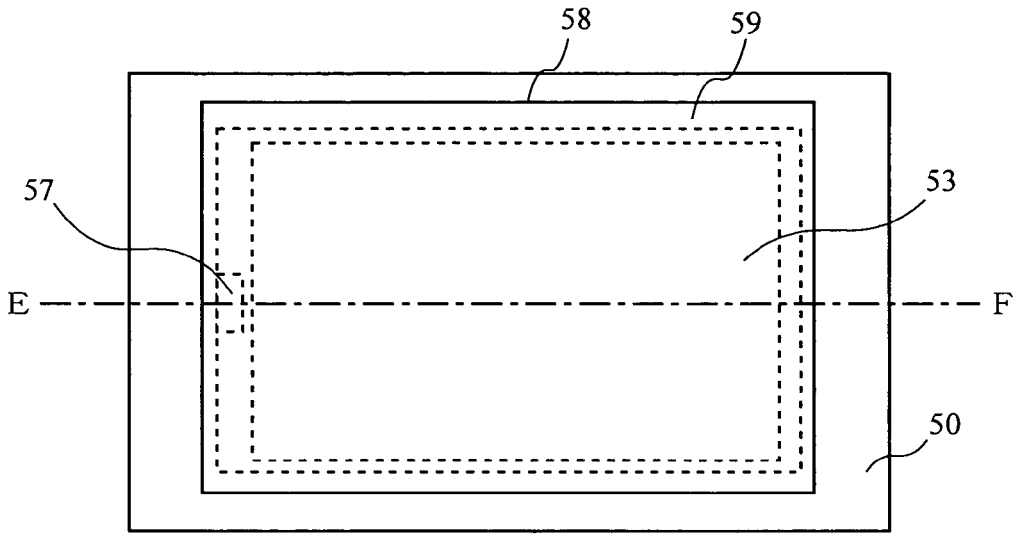
FIGS. 4A and 4B each illustrate a sound reproduction device according to a third embodiment.
Figure 4B:
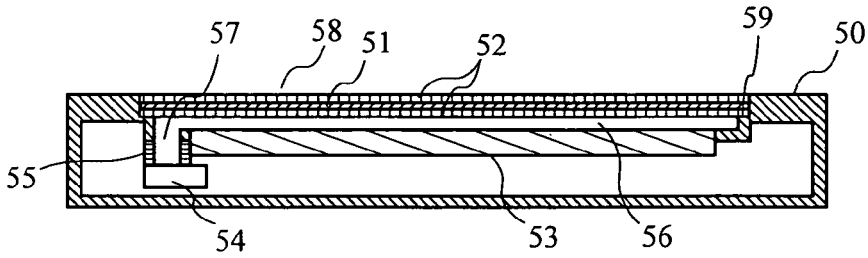

A sound reproduction device according to a third embodiment is described below. FIGS. 4A and 4B each illustrate the sound reproduction device according to the third embodiment. Specifically, FIG. 4A is a plan view of the sound reproduction device, and FIG. 4B is a cross-sectional view of the sound reproduction device taken along line E-F of FIG. 4A. In FIGS. 4A and 4B, the sound reproduction device includes a case 50, a film-like transparent diaphragm 51, transparent electrodes 52, an LCD 53, an electromechanical acoustic transducer 54, and an acoustic tube 55. In the third embodiment, a loudspeaker is used as a front panel. The LCD 53, which is a display device, is provided behind the loudspeaker.

The transparent diaphragm 51 is composed of a piezoelectric element such as a polymeric piezoelectric sheet material. The transparent electrodes 52 are bonded to opposite surfaces of the transparent diaphragm 51. The transparent diaphragm 51 and the transparent electrodes 52 form a transparent film-like loudspeaker 58. This loudspeaker 58 is fixed at its outer peripheral portion to a fixation surface 59 of the case 50. The case 50 supports the LCD 53. As shown in FIG. 4A, the LCD 53 is positioned such that a display portion thereof (an image displayed on the display portion) can be seen through from the outside of the sound reproduction device. Note that since the loudspeaker 58 is transparent, the LCD 53 and the fixation surface 59, which are indicated by dotted lines, can be seen through from the outside of the sound reproduction device. A space 56 is formed between the loudspeaker 58 and the LCD 53. The case 50 has a sound hole 57 in a portion facing the space 56. The acoustic tube 55 has one opening coupled to the sound hole 57, and another opening coupled to the electromechanical acoustic transducer 54. The acoustic tube 55 transfers sound emitted by the electromechanical acoustic transducer 54 through the sound hole 57 to the space 56. That is, the acoustic tube 55 plays a role in acoustically coupling the electromechanical acoustic transducer 54 to the sound hole 57.

Figure 5:
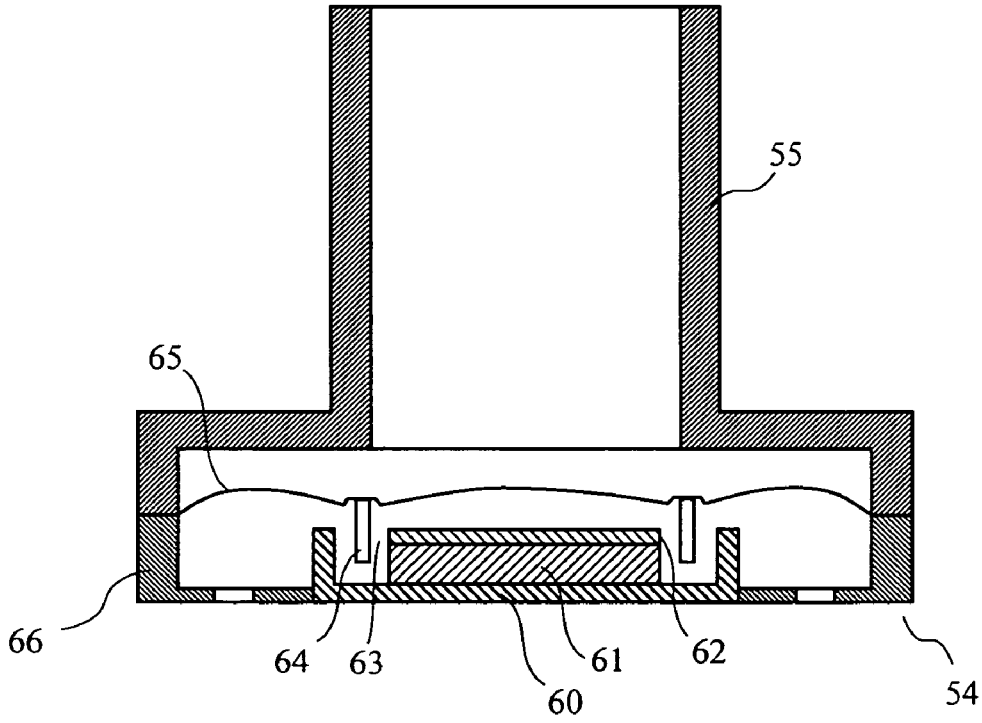
FIG. 5 is a cross-sectional view showing a structure of an electromechanical acoustic transducer 54 shown in FIG. 4A.

FIG. 5 is a cross-sectional view showing a structure of the electromechanical acoustic transducer 54 shown in FIG. 4A. Note that in the third embodiment, an electrodynamic loudspeaker is used as the electromechanical acoustic transducer 54. However, as described above, the transducer scheme of the electromechanical acoustic transducer 54 may be of, for example, a piezoelectric type, an electromagnetic type, or an electrostatic type. An electromechanical acoustic transducer of any type can achieve a similar effect so long as it has the capability of emitting sound from a diaphragm.

In FIG. 5, the electromechanical acoustic transducer 54 includes a pot-shaped yoke 60, a magnet 61 provided in a central portion of the yoke 60, a plate 62 placed on a top surface of the magnet 61, a frame 66 fixed at its central portion to a lower portion of an outer circumference of the yoke 60, a diaphragm 65 fixed at its outer peripheral portion to the frame 66, and a voice coil 64 connected to a central portion of the diaphragm 65. A magnetic space 63 is formed between an inner circumferential surface of the yoke 60 and an outer circumferential surface of the plate 62. The voice coil 64 is connected to the diaphragm 65 so as to be situated in the magnetic space 63. A top edge of the frame 66 is attached to the acoustic tube 55 such that the electromechanical acoustic transducer 54 blocks an opening of the acoustic tube 55.

Described next is an operation of the sound reproduction device structured as shown in FIGS. 4A, 4B, and 5. Note that when the loudspeaker 58 in the third embodiment is caused to emit sound, the loudspeaker 58 is acoustically driven by the electromechanical acoustic transducer 54, as well as being driven by the transparent electrodes 52. Firstly, the case where the loudspeaker 58 is acoustically driven by the sound reproduction device is described.

If an electrical signal is applied to the voice coil 64 situated in the magnetic space 63 of the electromagnetic acoustic transducer 54, a drive force is generated in the voice coil 64 to cause the diaphragm 65 coupled to the voice coil 64 to vibrate and thereby to generate sound. The sound generated by the diaphragm 65 is transferred through the acoustic tube 55 to the sound hole 57 and further to the space 56. Consequently, the film-like loudspeaker 58 fixed and supported at its outer peripheral portion is acoustically driven by sound pressure in the space 56 to vibrate and thereby to perform sound reproduction.

Next, the case where the loudspeaker 58 is driven by the transparent electrode 52 is described. The transparent electrodes 52 each are connected to a lead (not shown) from which an electrical signal is inputted through the transparent electrode 52 to the transparent electrode 51. The transparent electrode 51, which is made of a polymeric piezoelectric sheet material, generates bending vibration in response to the electrical signal, thereby generating sound.

As described above, the loudspeaker 58 in the present embodiment generates sound through a process where the loudspeaker 58 is acoustically driven by sound pressure of the electromechanical acoustic transducer 54 (hereinafter, referred to as a "first drive process"), and also generates sound through a process where the loudspeaker 58 drives itself in accordance with an applied electrical signal (hereinafter, referred to as a "second drive process"). In the first drive process, generally, there is difficulty in carrying out high-frequency sound reproduction. Specifically, the first drive process is based on a principle that the sound pressure in the space 56 causes the loudspeaker 58 to vibrate, and the space 56 has a characteristic of acting as a high-frequency cut-off acoustic filter which attenuates high-frequency sound. Accordingly, the first drive process essentially has difficulty in carrying out high-frequency sound reproduction. Note that although it is possible to improve a sound pressure level in a high-frequency band by reducing the width of the space 56 (i.e., a distance between the display panel and the LCD in a vertical direction in FIG. 4B), there is an essential limitation in high-frequency sound reproduction due to the principle of the first drive process.

In contrast, the second drive process essentially has difficulty in carrying out low-frequency sound reproduction. This is because a piezoelectric elements itself has a characteristic of having a low sound pressure level in a low-frequency band. Moreover, if the width of the space 56 behind the loudspeaker 58 is reduced in order to reduce a device size and in order to improve high-frequency sound reproduction in the first drive process, compliance of air is reduced.

Accordingly, in the third embodiment, the first and second drive processes are combined together so as to enable sound reproduction in a wide range from low to high frequency bands. Specifically, for low-frequency sound reproduction, the sound pressure of the electromechanical acoustic transducer 54 acoustically drives the loudspeaker 58 to vibrate and thereby to reproduce low-frequency sound. For high-frequency sound reproduction, the loudspeaker 58 drives itself to vibrate and thereby to reproduce high-frequency sound.

Note that in the above case, there is a possibility where a sound pressure level of reproduced sound might be reduced in a range where a frequency band (a low-frequency side band) which can be reproduced by the first process overlaps a frequency band (a high-frequency side band) which can be reproduced by the second process (hereinafter, such a range is referred to as an "overlap range"). Specifically, if vibration of the loudspeaker 58 caused by the first drive process is in antiphase with vibration of the loudspeaker 58 by the second drive process, a sound pressure level of reproduced sound in the overlap range is reduced. Accordingly, it is preferred to perform a predetermined signal process on input signals for use in the two drive processes. The signal process is described in detail below.

Figure 6:
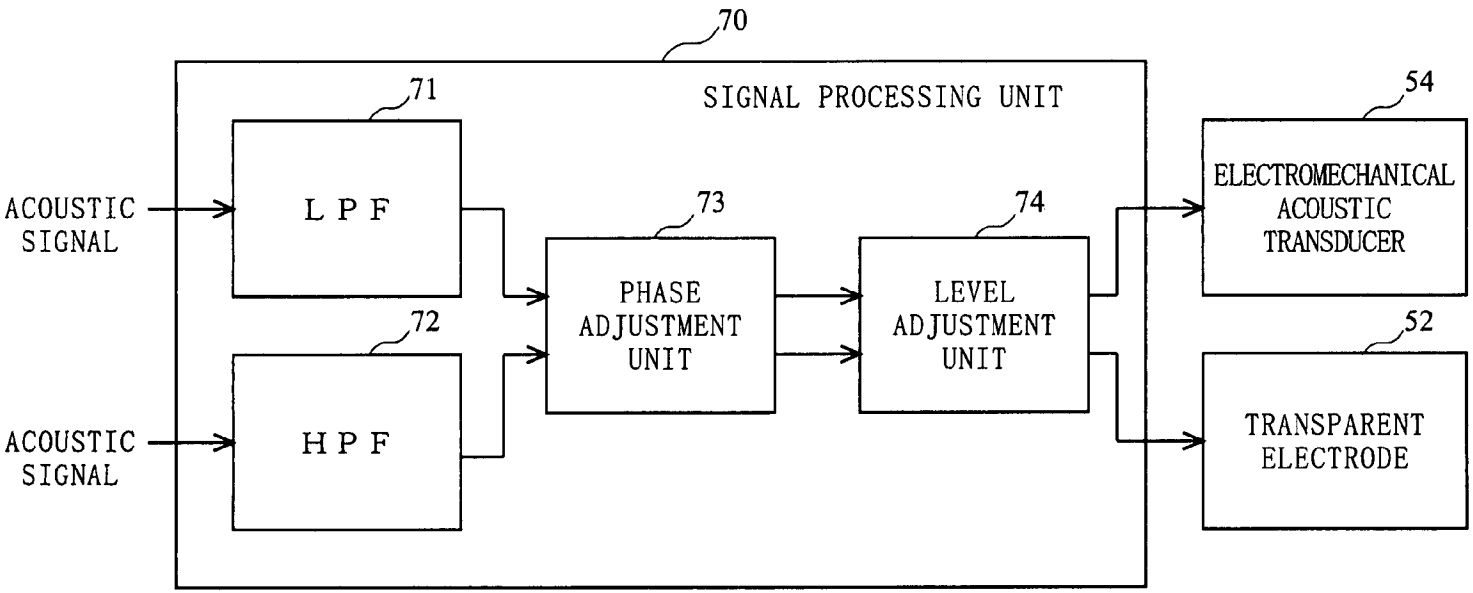
FIG. 6 is a block diagram showing functions in the sound reproduction device according to the third embodiment which are used for carrying out a signal process.

FIG. 6 is a block diagram showing functions in the sound reproduction device according to the third embodiment which are used for carrying out a signal process. As shown in FIG. 6, the sound reproduction device includes a signal processing unit 70 operable to perform a signal process on an acoustic signal to be reproduced. The signal processing unit 70 includes a low-pass filter (LPF) 71, a high-pass filter (HPF) 72, a phase adjustment unit 73, and a level adjustment unit 74. The signal processing unit 70 receives two acoustic signals. Note that the two acoustic signals are identical to each other, one of the two acoustic signals is inputted to the HPF 72, and the other acoustic signal is inputted to the LPF 71. One signal outputted from the signal processing unit 70 is inputted to the transparent electrodes 52, and another signal outputted from the signal processing unit 70 is inputted to the electromechanical acoustic transducer 54.

The LPF 71 is operable to extract a low-frequency component from an acoustic signal. A cut-off frequency of the LPF 71 is set at a frequency of sound which can be generated by the first drive process, i.e., a frequency at which the loudspeaker 58 can be driven by the first drive process. The HPF 72 is operable to extract a high-frequency component from an acoustic signal. A cut-off frequency of the HPF 72 is set at a frequency of sound which can be generated by the second drive process, i.e., a frequency at which the loudspeaker 58 can be driven by the second drive process. Note that the cut-off frequency of the LPF 71 is set at a frequency lower than the cut-off frequency of the HPF 72, such that a frequency band of a signal passing through the LPF 71 does not overlap a frequency band of a signal passing through the HPF 72. If the LPF 71 and the HPF 72 are ideal filters, the cut-off frequencies of the HPF 72 and the LPF 71 may be set so as to be equal to each other. In this case, only signals at frequencies lower than a predetermined frequency (i.e., a cut-off frequency) are inputted to the electromechanical acoustic transducer 54, and only signals at frequencies higher than the predetermined frequency are inputted to the transparent electrodes 52.

Thus, for a low-frequency range, only vibration caused by the first drive method is provided to the loudspeaker 58, and for a high-frequency range, only vibration caused by the second drive method is provided to the loudspeaker 58. In this manner, the overlap range is eliminated, thereby preventing a reduction of a sound pressure level. In general, a sound pressure level of sound reproduced by the first drive process has a characteristic of being reduced sharply at a specific frequency. Accordingly, in some cases, the sound pressure level of the sound reproduced by the first drive process might be sufficiently reduced in a high-frequency range without using an LPF. In such a case, the signal processing unit 70 may be configured so as to include only an HPF (without including the LPF).

Described next is a signal phase adjustment process. A signal outputted from the HPF 72 and a signal outputted from the LPF 71 are inputted to the phase adjustment unit 73. The phase adjustment unit 73 adjusts a phase of at least one of the two inputted signals. Specifically, the signal phase adjustment is carried out such that the two inputted signals are not in antiphase with each other in the overlap range. This also prevents a sound pressure level from being reduced in the overlap range.

Note that only one of the process, which uses the HPF 72 and the LPF 71, and the signal phase adjustment process may be performed. Even if only one of the processes is performed, it is possible to prevent a sound pressure level from being reduced in the overlap range.

Described next is a signal level adjustment process. In this process, if identical signals are inputted to the electromechanical acoustic transducer 54 and the transparent electrodes 52, a sound pressure level when the loudspeaker 58 is acoustically driven by the electromechanical acoustic transducer 54 is not always equal to a sound pressure level when the transparent electrodes 52 cause the loudspeaker 58 to drive itself. If both of the sound pressure levels are different from each other, loud sound is generated only in a low-frequency range, or reversely, loud sound is generated only in a high-frequency range. The level adjustment unit 74 performs a signal adjustment process such that a sound pressure level in a low-frequency range becomes substantially equal to a sound pressure level in a high-frequency range. The detailed description thereof is as follows.

Two signals outputted from the phase adjustment unit 73 are inputted to the level adjustment unit 74. The level adjustment unit 74 adjusts a level of at least one of the two inputted signals. Specifically, the signal level adjustment is carried out such that the sound pressure level when the loudspeaker 58 is acoustically driven by the electromechanical acoustic transducer 54 becomes substantially equal to the sound pressure level when the transparent electrodes 52 cause the loudspeaker 58 to drive itself. Thus, sound reproduction can be carried out substantially at the same sound level in both low-frequency and high-frequency ranges.

As described above, a signal process is performed on an acoustic signal to prevent a reduction of a sound pressure level in the overlap range or to prevent a difference in the sound pressure level between the low-frequency and high-frequency ranges. In another embodiment, the above problems may be prevented by adjusting a characteristic of the sound reproduction device. For example, by changing the width of the space 56, it is possible to adjust a frequency band which can be reproduced by the first drive process. Alternatively, for example, by changing a ratio between an area of the loudspeaker 58 and an area of the diaphragm 65, it is possible to adjust a sound pressure level of sound reproduced by the first drive process. Similarly, by adjusting characteristics of the transparent diaphragm 51 and the transparent electrodes 52, it is possible to adjust a frequency band which can be reproduced by the second drive process or a sound pressure level of sound reproduced by the second drive process.

As described above, in the third embodiment, it is possible to make the user feel as if sound is being generated by a display screen of a display device. Moreover, a loudspeaker is used as a front panel to enable wide-frequency sound reproduction.

Note that the sound reproduction device according to the third embodiment achieves high-quality sound reproduction even if the display device (i.e., the LCD 53) is not provided. Accordingly, a loudspeaker drive process described in the third embodiment achieves an effect advantageous not only for the purpose of simultaneous reproduction of an image and sound but also for the purpose of merely achieving high-quality sound reproduction. A sound reproduction device merely intended for high-quality sound reproduction is described in the following fourth embodiment.

Fourth Embodiment

Figure 7A:
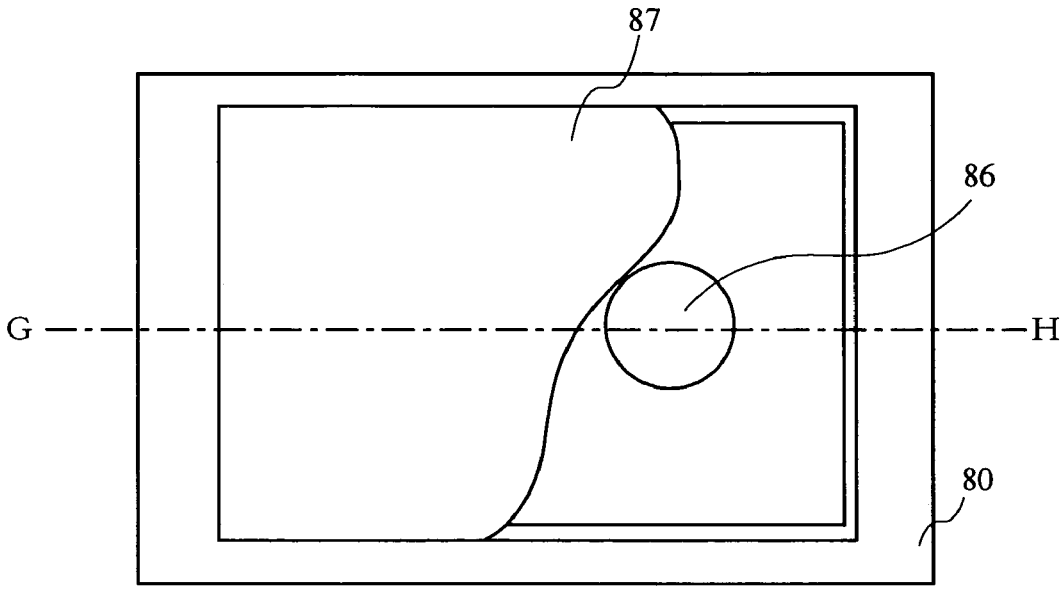
FIGS. 7A and 7B each illustrate a sound reproduction device according to a fourth embodiment.
Figure 7B:
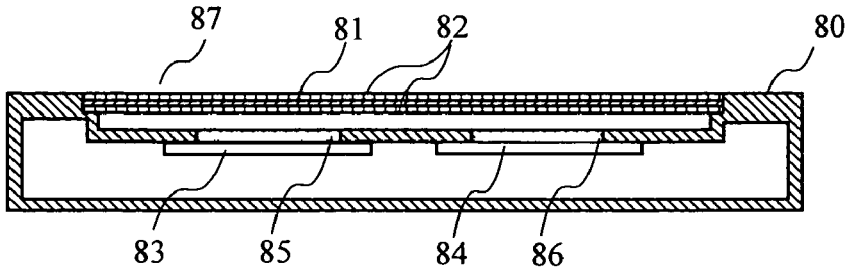

A sound reproduction device according to a fourth embodiment is described below. As described above, in the fourth embodiment, a driving process of the sound reproduction device according to the third embodiment is applied to a sound reproduction device merely intended for high-quality sound reproduction. FIGS. 7A and 7B each illustrate the sound reproduction device according to the fourth embodiment. Specifically, FIG. 7A is a plan view of the sound reproduction device shown partially broken away, and FIG. 7B is a cross-sectional view of the sound reproduction device taken along line G-H of FIG. 7A. In FIGS. 7A and 7B, the sound reproduction device includes a case 80, a loudspeaker 87 (consisting of a transparent diaphragm 81 and transparent electrodes 82), and electromechanical acoustic transducers 83 and 84. Note that in FIG. 7A, the loudspeaker 87 is shown partially broken away. The sound reproduction device shown in FIG. 7A differs from the sound reproduction device shown in FIG. 4A in that no LCD is included, no acoustic tube is included, and two sets of sound holes and the electromechanical acoustic transducers are included. Other elements of the sound reproduction device are similar to those of the sound reproduction device shown in FIG. 4A, and therefore the detailed descriptions thereof are omitted herein.

In FIG. 7A, the sound reproduction device includes no LCD, and therefore is not required to include an acoustic tube. Specifically, if the LCD is included, it is necessary to arrange the LCD behind the loudspeaker, and therefore it is necessary to arrange the electromechanical acoustic transducer behind the LCD. In the third embodiment, the acoustic tube is used for realizing the above arrangements, while in the forth embodiment, there is no need to use the acoustic tube. Moreover, in the fourth embodiment, the sound reproduction device includes two electromechanical acoustic transducers, and accordingly two sound holes 85 and 86 are provided. Note that the sound reproduction device may be configured so as to include only one electromechanical acoustic transducer and only one sound hole.

An operation of the sound reproduction device shown in FIG. 7A is similar to that of the sound reproduction device according to the third embodiment. That is, the sound reproduction device shown in FIG. 7A is caused to generate high-frequency sound by the first drive process, and also caused to generate low-frequency sound by the second drive process. In the fourth embodiment, as in the third embodiment, it is preferred that the sound reproduction device includes a signal processing unit as shown in FIG. 6.

As described above, in the fourth embodiment, two drive processes are used together to realize a sound reproduction device capable of wide-frequency sound reproduction. Note that in the fourth embodiment, it is not intended to carry out image reproduction, and therefore the loudspeaker is not required to be made of a transparent material. That is, instead of using the transparent diaphragm 81 and the transparent electrodes 82, an opaque material is used. Moreover, a loudspeaker having characters or pictures printed thereon may be used. For example, it is possible to realize a sound reproduction device including a loudspeaker which can be used in a manner similar to a poster, thereby making user feel as if sound is being reproduced from the poster.

Fifth Embodiment

Figure 8A:
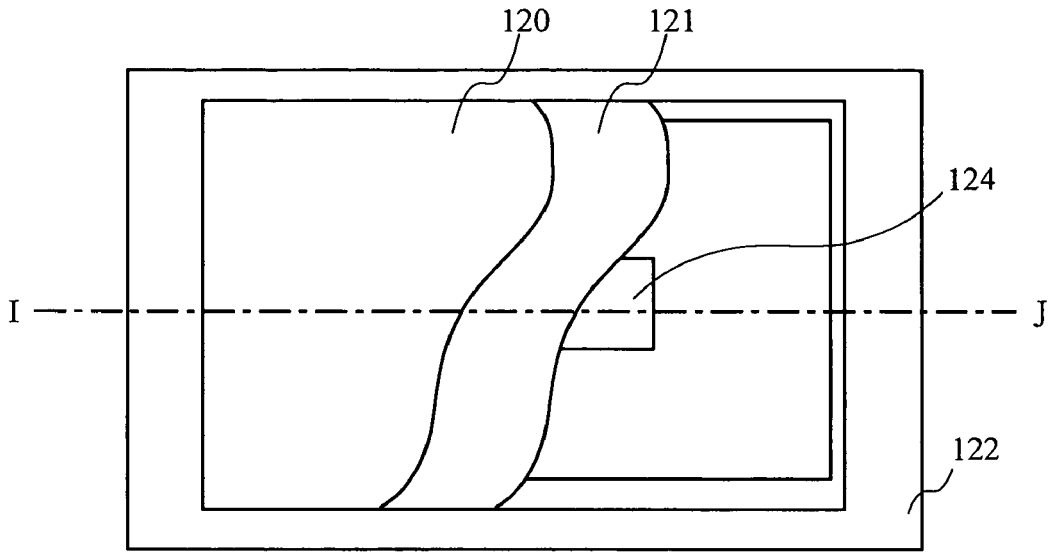
FIGS. 8A and 8B each illustrate a sound reproduction device according to a fifth embodiment.
Figure 8B:
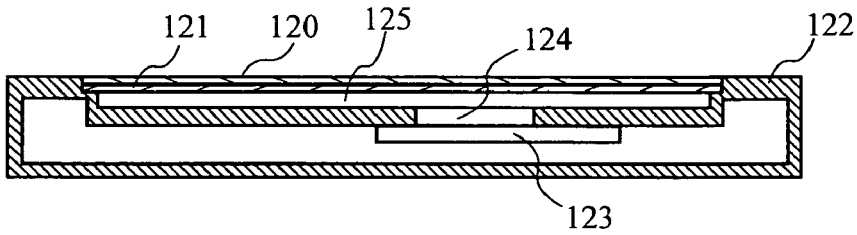

A sound reproduction device according to a fifth embodiment is described below. FIGS. 8A and 8B each illustrate the sound reproduction device according to the fifth embodiment. Specifically, FIG. 8A is a plan view of the sound reproduction device, and FIG. 8B is a cross-sectional view of the sound reproduction device taken along line I-J of FIG. 8A. In FIGS. 8A and 8B, the sound reproduction device includes a film-like organic EL panel 120, a piezoelectric film 121, a case 122, and an electromechanical acoustic transducer 123. Note that in FIG. 8A, the organic EL panel 120 and the piezoelectric film 121 are shown partially broken away. In the fifth embodiment, as shown in FIG. 8B, the organic EL panel 120, which is an exemplary image display panel for displaying an image, and the piezoelectric film 121, which is an exemplary sound generation panel for emitting sound, are integrated into a front panel.

The sound reproduction device configured as shown in FIGS. 8A and 8B differs from the sound reproduction devices according to the second and third embodiments in that the organic EL panel 120, which is an image display panel, and the piezoelectric film 121, which is a sound generation panel, are integrally formed. Specifically, the sound reproduction device shown in FIGS. 8A and 8B is configured by bonding a piezoelectric film to a bottom surface of the organic EL panel 40 of the sound reproduction device shown in FIG. 2.

An operation of the sound reproduction device shown in FIGS. 8A and 8B is similar to that of the sound reproduction device according to the third embodiment. Specifically, the front panel (i.e., the organic EL panel 120 and the piezoelectric film 121) of the sound reproduction device according to the fifth embodiment is acoustically driven by sound pressure of the electromechanical acoustic transducer 123 to generate sound, and the piezoelectric film 121 is driven by an electrical signal applied thereto, thereby generating sound. More specifically, sound generated by the electromechanical acoustic transducer 123 is transferred through a sound hole 124 to a space 125. As a result, the piezoelectric film 121 and the organic EL panel 120 are caused to vibrate by energy (sound pressure) of the sound emitted from the electromechanical acoustic transducer 123 to the space 125. Moreover, since the piezoelectric film 121 and the organic EL panel 120 are integrated together, if an acoustic signal is applied to the piezoelectric film 121, vibration generated in the piezoelectric film 121 causes the organic EL panel 120 to vibrate.

As described above, in the fifth embodiment, as in the third embodiment, two drive processes cause the front panel to vibrate and thereby to emit sound. Accordingly, in the fifth embodiment, as in the third embodiment, by configuring the sound reproduction device to further include the signal processing unit 70 shown in FIG. 6, it is made possible to reproduce sounds in different frequency bands. Specifically, the sound pressure of the electromechanical acoustic transducer 54 acoustically drives the front panel to vibrate and thereby to reproduce low-frequency sound, and vibration of the piezoelectric film 121 drives the front panel to vibrate and thereby to reproduce high-frequency sound.

In the fifth embodiment, as in the second embodiment, it is possible to realize a thin sound reproduction device capable of simultaneously reproducing an image and sound using the front panel. Moreover, since the piezoelectric film is further included, insufficient output in a high-frequency range, which might be caused in the second embodiment, can be avoided. Similar to the sound reproduction devices according to the first, second, and third embodiments, the sound reproduction device according to the fifth embodiment can typically be applied to an electronic apparatus, such as a mobile telephone, a game apparatus, a personal computer, and a television.

Note that in the fifth embodiment, the piezoelectric film 121 is bonded to the bottom surface of the organic EL panel 120. However, if a transparent piezoelectric film is used, the piezoelectric film may be bonded to a top surface of the organic EL panel. Alternatively, the piezoelectric film may be provided on each surface of the organic EL panel 120. This increases a sound conversion efficiency, and therefore the sound reproduction device is able to perform sound reproduction with a larger sound pressure level.

Figure 9A:
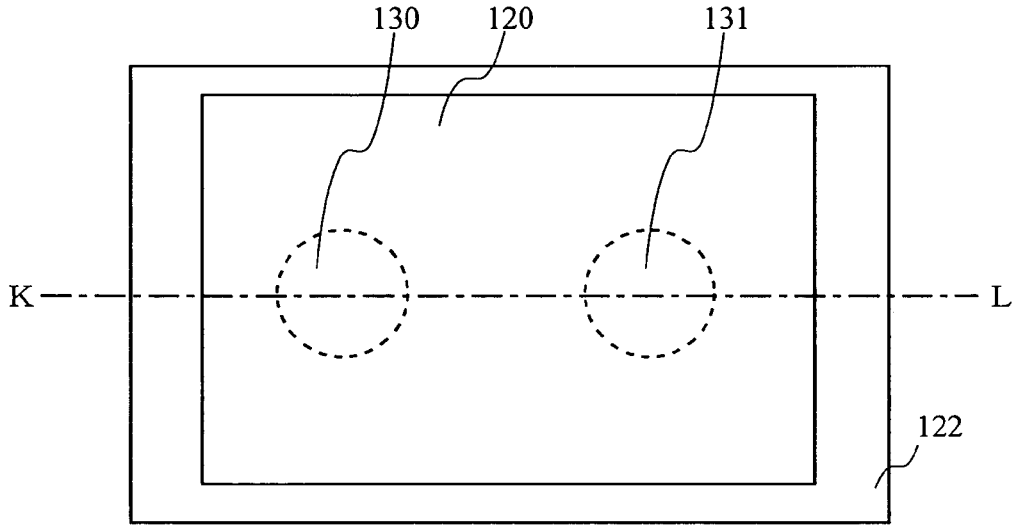
FIGS. 9A and 9B each illustrate a sound reproduction device according to a sixth embodiment.
Figure 9B:
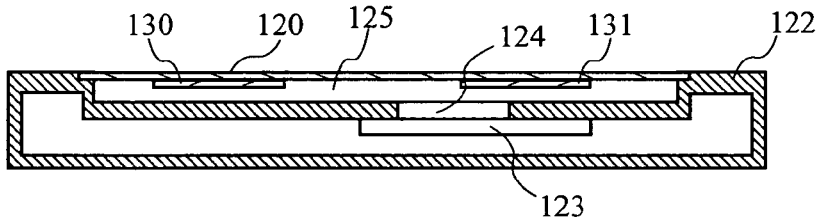

Further, although in FIG. 8, the piezoelectric film is provided across the entire surface of the organic EL panel 120, as shown in FIGS. 9A and 9B, the piezoelectric film may be provided over a part of the entire surface of the organic EL panel 120. FIG. 9A is a plane view of a variation of the sound reproduction device according to the fifth embodiment, and FIG. 9B is a cross-sectional view of the sound reproduction device taken along line K-L of FIG. 9A. In FIGS. 9A and 9B, elements similar to those shown in FIGS. 8A and 8B are denoted by the same reference numerals.

The sound reproduction device shown in FIGS. 9A and 9B differs from the sound reproduction device shown in FIGS. 8A and 8B in that the piezoelectric elements 130 and 131 are provided on portions of organic EL panel 120. In this case, the piezoelectric elements shown in FIG. 2 can be used as the piezoelectric elements 130 and 131. In the sound reproduction device configured as shown in FIGS. 9A and 9B, a sound emission efficiency is generally low, and sound reproduction can be performed with a small vibration area as compared to a piezoelectric film which requires a large area to maintain a satisfactory sound pressure level.

Further, in the case of using the two piezoelectric elements 130 and 131, it is possible to perform stereo reproduction mainly in a high-frequency range. Moreover, since two sound holes are provided to the case 122 and an electromechanical acoustic transducer is provided to each sound hole, it is also possible to perform stereo reproduction in a low-frequency range.

Note that although the shape of the piezoelectric elements shown in FIGS. 9A and 9B is circular, the piezoelectric elements can be of any shape, e.g., rectangular, oval, etc. moreover, although the piezoelectric elements shown in FIGS. 9A and 9B are used sound generation panels to be bonded to the organic EL panel, sound generation members of any acoustic transducer scheme, e.g., an electrodynamic type, an electromagnetic type, or an electrostatic type, can be used as the sound generation panels.

Sixth Embodiment

Figure 10:
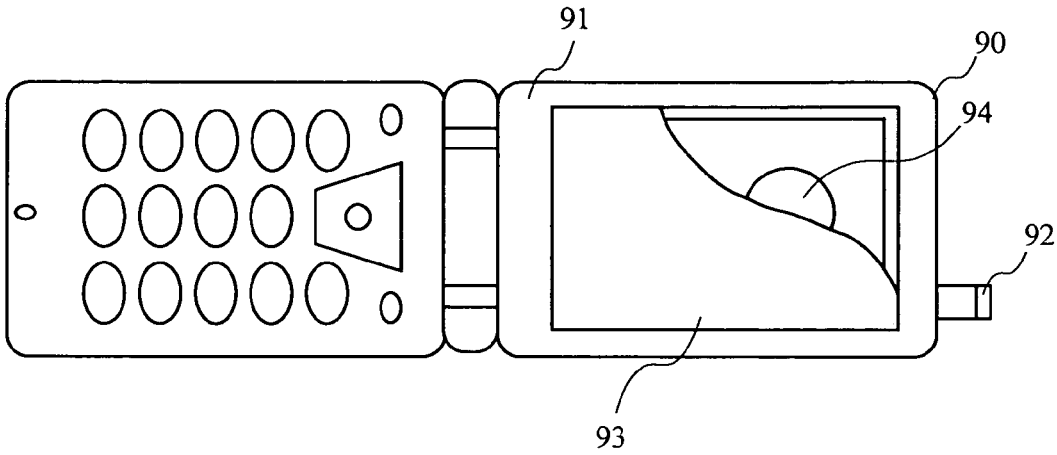
FIG. 10 is an external view of a mobile telephone which is an example of an electronic apparatus according to a sixth embodiment.

A sound reproduction device according to a sixth embodiment is described below. The sixth embodiment is described with respect to an exemplary case where the sound reproduction device according to the second embodiment is used in a mobile telephone which is an exemplary electronic apparatus. FIG. 10 is an external view of a mobile telephone which is an example of the electronic apparatus according to the sixth embodiment. In FIG. 10, a mobile telephone 90 includes a case 91, an antenna 92, and an organic EL panel 93. Included in the case 91 are a signal processing circuit, an electromechanical acoustic transducer, etc., which are not shown. The case 91 is provided with a sound hole 94 for transferring sound emitted by the electromechanical transducer. The organic EL panel 93 is a display panel attached to the case 91, and operable to display an image based on an electrical signal. Note that in FIG. 10, the organic EL panel 93 is shown partially broken away. The case 91, the organic EL panel 93, the sound hole 94, and the electromechanical acoustic transducer are configured in a similar manner to corresponding elements shown in FIG. 3.

Figure 11:
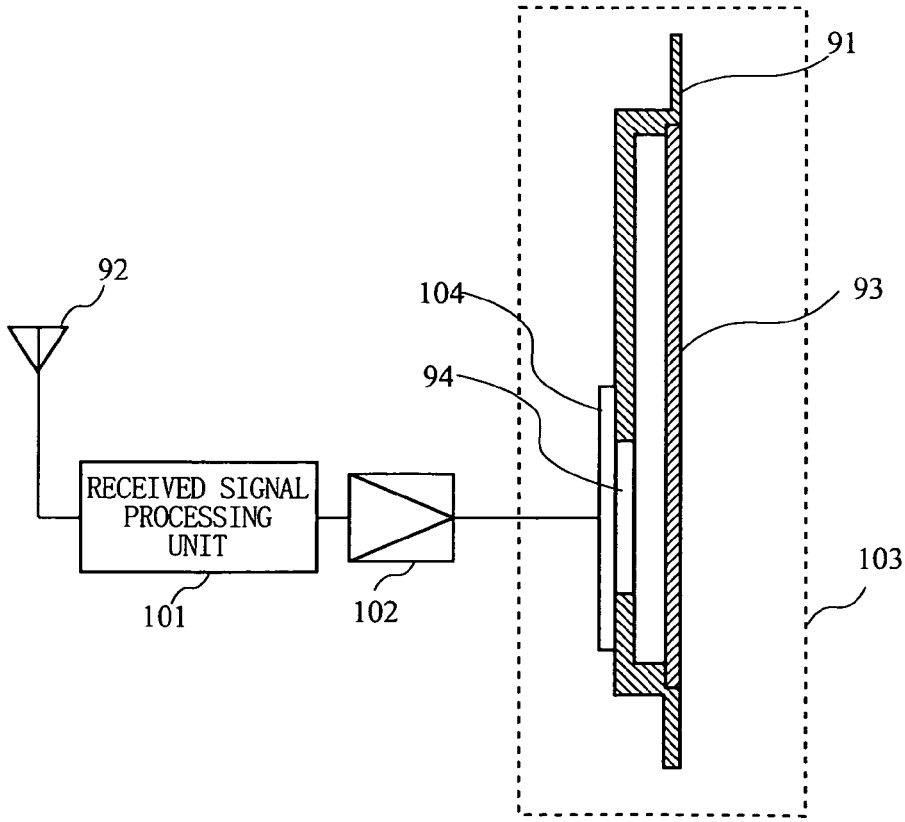
FIG. 11 is a block circuit diagram showing a principal part of the mobile telephone shown in FIG. 10.
Figure 12:
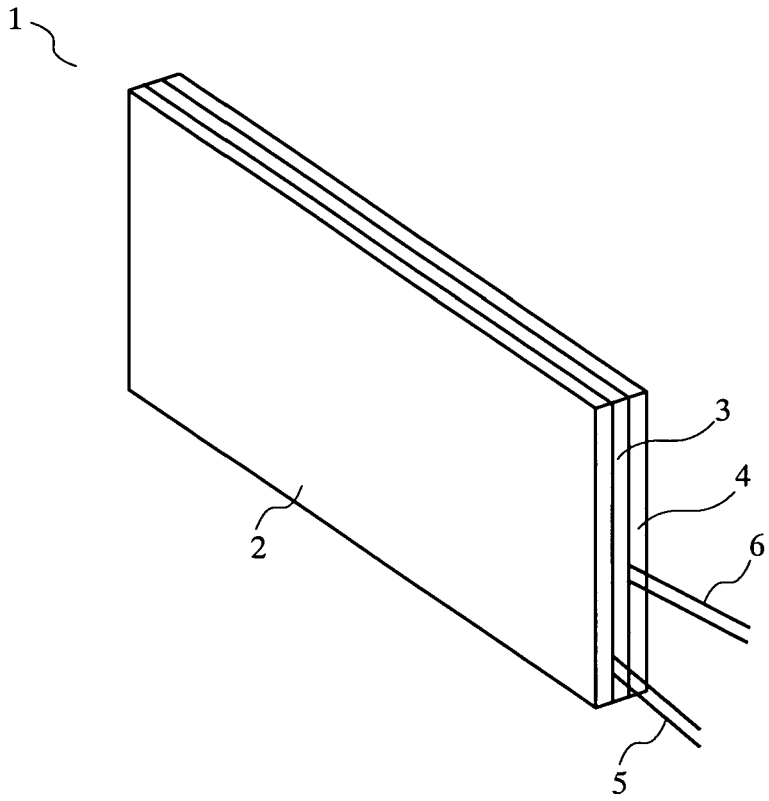
FIG. 12 PRIOR ART
FIG. 12 is a perspective view showing a conventional display device having a sound reproduction capability.

FIG. 11 is a block circuit diagram showing a principal part of the mobile telephone shown in FIG. 10. In FIG. 11, the mobile telephone 90 includes a received signal processing unit 101, a signal amplification unit 102, and a sound reproduction device 103. Note that the sound reproduction device 103 is configured in the same manner as the sound reproduction device according to the second embodiment shown in FIG. 2.

An operation of the mobile telephone configured as shown in FIGS. 10 and 11 is described below. The antenna 92 receives a signal sent from a base station of the mobile telephone. The signal includes a ringing signal indicating an incoming call, an incoming speech signal indicating an incoming speech sound, an acoustic signal such as music, or an image signal such as a moving image or textual information. The signal received by the antenna 92 is inputted to the received signal processing unit 101, and the signal inputted to the received signal processing unit 101 undergoes signal processing. Specifically, the received signal processing unit 101 transforms the inputted signal into an acoustic signal. If the inputted signal contains an image signal, the received signal processing unit 101 inputs the image signal to the organic EL panel 93. The acoustic signal is amplified by the signal amplification unit 102, and inputted to an electromechanical acoustic transducer 104 in the sound reproduction device 103. Note that the signal amplification unit 102 is capable of changing an amplification factor in accordance with a user's instruction (which is inputted via an input unit (not shown)), and changes the amplification factor in accordance with a usage form of the mobile telephone. The electromechanical acoustic transducer 104 reproduces the acoustic signal outputted from the amplification unit 102 on a vibrating front panel (i.e., the organic EL panel 93). Note that the operation of the sound reproduction device is as described in the second embodiment, and therefore the detailed description thereof is omitted herein in order to avoid unnecessary duplication of description.

Note that when a user uses the mobile telephone, the user may hold his/her ear close to the organic EL panel 93 which emits sound or the user may use the mobile telephone as a hands-free telephone to speak with his/her face apart from the mobile telephone. If both mobile telephones on caller and receiver sides have a camera mounted thereon and thus have the capability of a video telephone, the mobile telephones can be used as hands-free telephones to have a conversation while seeing the face of the person on the other end of the phone which is displayed on the front panel. In this case, if the mobile telephone shown in FIG. 10 is used, it is possible to make the user feel as if the voice of the person on the other end of the phone is coming from the image of the face of the person on the other end of the phone. Note that in the case where the mobile telephone can be used as a hands-free telephone, the front panel can operate as a loudspeaker. Moreover, depending on the type of the front panel, it is possible to reproduce an alarm sound or a melody sound which indicates an incoming call, or a music signal. As an application of simultaneous reproduction of a music signal and an image signal, it is possible to reproduce music promotion video or it is possible to use the mobile telephone as a game apparatus.

As described above, in the sixth embodiment, it is possible to realize a mobile telephone in which sound is reproduced from a display screen. Note that in the sixth embodiment, although the sound reproduction device 103 is a device which includes an organic EL panel (i.e., the sound reproduction device according to the second embodiment), the sound reproduction device 103 may be a device which includes an LCD (i.e., the sound reproduction device according to the first embodiment). Alternatively, the sound reproduction device 103 may be a sound reproduction device according to the third or fifth embodiment. Moreover, in the sixth embodiment, although the mobile telephone is described as an example, the sound reproduction devices according to the first through third and fifth embodiments can be readily applied to an electronic apparatus having a display screen, such as a television, a personal computer, a game apparatus, a car navigation system, etc. Moreover, the sound reproduction devices according to the first through third and fifth embodiments can be reduced in thickness, and therefore it is advantageous to apply the sound reproduction devices to portable terminal apparatuses, such as mobile telephones, etc.

As described above, in the present invention, a display device itself can be used as a front panel, and the display device (the LCD or organic EL panel as described above) is acoustically driven to generate sound from the display device itself. Further, by acoustically driving the display device, it is possible to provide satisfactory low-frequency sound reproduction. Furthermore, in the present invention, a loud speaker, such as a piezoelectric element, can be used as the front panel to enable wide-frequency sound reproduction.

While the invention has been described in detail, the foregoing description is in all aspects illustrative and not restrictive. It is understood that numerous other modifications and variations can be devised without departing from the scope of the invention.

What is claimed is:

1. A sound reproduction device comprising:

a front panel which performs a predetermined operation in response to an electrical signal applied thereto;

a case which forms a sound emission space with the front panel; and an electromechanical acoustic transducer operable to emit sound to the sound emission space, the electromechanical acoustic transducer being connected to the case, wherein if the electromechanical acoustic transducer emits the sound to the sound emission space, energy of the emitted sound causes the front panel to vibrate and thereby to externally output sound.

2. The sound reproduction device according to claim 1, wherein the front panel is an image display panel which displays an image in response to the electrical signal.

3. The sound reproduction device according to claim 2, wherein the image display panel is a liquid crystal display.

4. The sound reproduction device according to claim 3, wherein the case supports an outer peripheral portion of the liquid crystal display via an elastic body.

5. The sound reproduction device according to claim 2, wherein the front panel is an organic electroluminescent panel.

6. The sound reproduction device according to claim 1, wherein the front panel includes:

an image display panel which displays an image in response to the electrical signal; and a sound generation panel which reproduces the sound in response to the electrical signal, the sound generation panel being integrally formed with the image display panel.

7. The sound reproduction device according to claim 6, wherein the sound generation panel is provided across an entire surface of the image display panel or a part of the entire surface.

8. The sound reproduction device according to claim 6, wherein the sound generation panel is driven by any one of an electrodynamic scheme, an electromagnetic scheme, an electrostatic scheme, and a piezoelectric scheme.

9. The sound reproduction device according to claim 2, wherein an image signal to be reproduced is inputted to the front panel, and an acoustic signal to be reproduced is inputted to the electromechanical acoustic transducer.

10. The sound reproduction device according to claim 9, further comprising a signal amplification unit operable to amplify the acoustic signal to be reproduced, wherein the signal amplification unit is capable of changing an amplification factor in accordance with a user's instruction.

11. The sound reproduction device according to claim 1, wherein the front panel is a sound generation panel operable to reproduce sound in response to the electrical signal.

12. The sound reproduction device according to claim 11, wherein the sound generation panel is composed of a piezoelectric element.

13. The sound reproduction device according to claim 11, further comprising a high-frequency component extraction unit operable to extract a high-frequency component higher than a first predetermined frequency from an acoustic signal to be reproduced, wherein the sound generation panel receives a signal of the high-frequency component extracted by the high-frequency component extraction unit, and wherein the electromechanical acoustic transducer receives the acoustic signal.

14. The sound reproduction device according to claim 11, further comprising: a high-frequency component extraction unit operable to extract a high-frequency component higher than a first predetermined frequency from an acoustic signal to be reproduced; and a low-frequency component extraction unit operable to extract a low-frequency component lower than a second predetermined frequency, which is lower than or equal to the first predetermined frequency, from the acoustic signal, wherein the sound generation panel receives a signal of the high-frequency component extracted by the high-frequency component extraction unit, and wherein the electromechanical acoustic transducer receives a signal of the low-frequency component extracted by the low-frequency component extraction unit.

15. The sound reproduction device according to claim 11, further comprising a level adjustment unit operable to perform a level adjustment on at least either an acoustic signal to be inputted to the sound generation panel or an acoustic signal to be inputted to the electromechanical acoustic transducer, such that a reproduction sound pressure level of the sound generation panel in the case where a predetermined acoustic signal is inputted to the sound generation panel is substantially equal to a reproduction sound pressure level of the sound generation panel in the case where the predetermined acoustic signal is inputted to the electromechanical acoustic transducer.

16. The sound reproduction device according to claim 11, further comprising a phase adjustment unit operable to perform a phase adjustment on at least either an acoustic signal to be inputted to the sound generation panel or an acoustic signal to be inputted to the electromechanical acoustic transducer, such that sound reproduced by the sound generation panel in the case where a predetermined acoustic signal is inputted to the sound generation panel and sound reproduced by the sound generation panel in the case where the predetermined acoustic signal is inputted to the electromechanical acoustic transducer are not in antiphase with each other in a predetermined frequency band.

17. The sound reproduction device according to claim 11, wherein the sound generation panel is made of a transparent material.

18. The sound reproduction device according to claim 1, wherein the case has a sound hole, and wherein the electromechanical acoustic transducer emits the sound from the sound hole to the sound emission space.

19. The sound reproduction device according to claim 1, further comprising an acoustic tube coupling the case to the electromechanical acoustic transducer, wherein the case has a sound hole at a connection to the acoustic tube, and wherein the electromechanical acoustic transducer emits the sound from the sound hole through the acoustic tube to the sound emission space.

20. The sound reproduction device according to claim 1, wherein the electromechanical acoustic transducer is driven by any one of an electrodynamic scheme, an electromagnetic scheme, an electrostatic scheme, and a piezoelectric scheme.

21. A portable terminal apparatus comprising: a sound reproduction device of claim 1; an antenna operable to receive a received signal containing at least one of acoustic and image signals; and a received signal processing unit operable to perform a predetermined signal process on the received signal, wherein if the received signal contains the image signal, the received signal processing unit inputs the image signal to a front panel, and if the received signal contains the acoustic signal, the received signal processing unit inputs the acoustic signal to an electromechanical acoustic transducer.

22. The portable terminal apparatus according to claim 21, wherein the acoustic signal is an incoming speech signal indicating an incoming speech sound, and wherein the electromechanical acoustic transducer receives the incoming speech signal as the acoustic signal.

23. The portable terminal apparatus according to claim 22, further comprising an amplification unit operable to amplify the acoustic signal to be inputted to the electromechanical acoustic transducer, wherein an amplification factor of the signal amplification unit is variable.

* * * * *